US006764982B2

(12) United States Patent
Bardasz et al.

(10) Patent No.: US 6,764,982 B2
(45) Date of Patent: Jul. 20, 2004

(54) LUBRICATING OIL COMPOSITION

(75) Inventors: Ewa A. Bardasz, Mentor, OH (US); Virginia A. Carrick, Chardon, OH (US); William D. Abraham, South Euclid, OH (US); Gordon D. Lamb, Mickleover (GB)

(73) Assignee: The Lubrizol Corporation, Wickliffe, OH (US)

( * ) Notice: Subject to any disclaimer, the term of this patent is extended or adjusted under 35 U.S.C. 154(b) by 162 days.

(21) Appl. No.: 10/061,978

(22) Filed: Jan. 31, 2002

(65) Prior Publication Data

US 2002/0151442 A1 Oct. 17, 2002

Related U.S. Application Data

(60) Provisional application No. 60/266,990, filed on Feb. 7, 2001.

(51) Int. Cl.[7] ..... C10M 141/10

(52) U.S. Cl. ..... 508/293; 508/371; 508/390; 508/433; 508/441; 508/442; 508/518; 508/578; 508/585; 508/586

(58) Field of Search ..... 508/291, 293

(56) References Cited

U.S. PATENT DOCUMENTS

| | | | | |
|---|---|---|---|---|
| 2,250,188 | A | 7/1941 | Wilson | 252/39 |
| 2,647,873 | A | 8/1953 | Matthews et al. | 252/42.7 |
| 3,256,183 | A | 6/1966 | Greenwald | 252/32.7 |
| 4,053,428 | A | 10/1977 | Pindar et al. | 252/52 |
| 4,701,354 | A | 10/1987 | Kitamura et al. | 427/255.6 |
| 4,904,401 | A | 2/1990 | Ripple et al. | 252/32.7 |
| 4,916,031 | A | 4/1990 | Kitamura et al. | 428/626 |
| 4,943,672 | A | 7/1990 | Hammer et al. | 585/737 |
| 5,240,624 | A | 8/1993 | Koch | 252/49.6 |
| 5,259,967 | A | 11/1993 | Ripple | 252/32.007 E |
| 5,371,140 | A | 12/1994 | Parks | 525/54.42 |
| 5,378,791 | A | 1/1995 | Lancaster et al. | 528/137 |
| 5,516,441 | A | 5/1996 | Denis | 252/42.7 |
| 5,665,684 | A | 9/1997 | Arai et al. | 508/365 |
| 5,719,107 | A | 2/1998 | Outten et al. | 508/185 |
| 5,882,505 | A | 3/1999 | Wittenbrink et al. | 208/59 |
| 5,958,848 | A | 9/1999 | Robson | 508/232 |
| 6,013,171 | A | 1/2000 | Cook et al. | 208/27 |
| 6,080,301 | A | 6/2000 | Beriowitz et al. | 208/18 |
| 6,096,940 | A | 8/2000 | Wittenbrink et al. | 585/750 |
| 6,103,099 | A | 8/2000 | Wittenbrink et al. | 208/27 |
| 6,103,672 | A | 8/2000 | Dunn et al. | 508/185 |
| 6,165,949 | A | 12/2000 | Beriowitz et al. | 508/363 |
| 6,180,575 | B1 | 1/2001 | Nipe | 508/227 |
| 6,310,009 | B1 | 10/2001 | Kocsis et al. | 508/186 |
| 6,331,510 | B1 * | 12/2001 | Curtis et al. | 508/578 |
| 6,583,092 | B1 * | 6/2003 | Carrick et al. | 508/198 |
| 6,605,572 | B2 * | 8/2003 | Carrick et al. | 508/198 |
| 6,610,637 | B2 * | 8/2003 | Curtis et al. | 508/578 |

FOREIGN PATENT DOCUMENTS

| | | |
|---|---|---|
| EP | 382 242 | 8/1990 |
| EP | 552 863 | 7/1993 |
| EP | 599 251 | 6/1994 |
| EP | 952 207 | 10/1999 |
| EP | 1 167 497 A2 | 6/2000 |

* cited by examiner

*Primary Examiner*—Ellen M. McAvoy
(74) *Attorney, Agent, or Firm*—David M. Shold; Michael F. Esposito

(57) ABSTRACT

This invention relates to a lubricating oil composition, comprising: (A) a base oil; and a phosphorus-containing compound represented by the formulae (B-I)

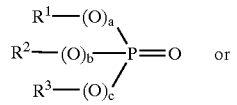

or (B-II)

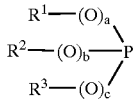

wherein in Formulae (B-I) and (B-II), $R^1$, $R^2$ and $R^3$ are independently hydrogen or hydrocarbyl groups, and a, b and c are independently zero or 1; the lubricating oil composition being characterized by a sulfur content of about 0.01 to about 0.25% by weight.

33 Claims, No Drawings

LUBRICATING OIL COMPOSITION

The disclosure in U.S. Provisional Application No. 60/266,970, filed Feb. 7, 2001 is incorporated herein by reference in its entirety.

TECHNICAL FIELD

This invention relates to lubricating oil compositions. More particularly, this invention relates to lubricating oil compositions containing relatively low levels of sulfur.

BACKGROUND OF THE INVENTION

In the ever-increasing effort to reduce exhaust gas emissions from internal combustion engines, manufacturers of gasoline powered engines and diesel engines are turning more and more to using exhaust gas after treatment devices (e.g., catalytic converters, particulate traps, etc.) to reduce emissions. A problem with using such devices, however, is that lubricating oil compositions containing relatively high levels of sulfur eventually decompose and the decomposition products of these lubricants, including the sulfur, eventually enter the after treatment device and often contribute to damaging the device. Additionally, the allowable level of sulfur in diesel and gasoline fuels is expected to drop to 15 parts per million (ppm) with zero-sulfur fuel already being required in select locations. Therefore, a substantial portion of the sulfur in the emissions of these engines can be expected to be attributed to sulfur in the lubricant. This has resulted in pressure to reduce sulfur levels in the lubricating oil compositions used in these engines.

The present invention provides a solution to this problem by providing lubricating oil compositions containing relatively low levels of sulfur.

SUMMARY OF THE INVENTION

This invention relates to a lubricating oil composition, comprising: (A) a base oil; and (B) a phosphorus-containing compound represented by the formulae (B-I)

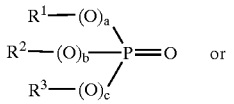

or (B-II)

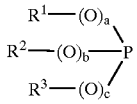

wherein in Formulae (B-I) and (B-II), $R^1$, $R^2$ and $R^3$ are independently hydrogen or hydrocarbyl groups, and a, b and c are independently zero or 1; the lubricating oil composition being characterized by a sulfur content of about 0.01 to about 0.25% by weight. In one embodiment, the lubricating oil composition further comprises (C) an acylated nitrogen-containing compound having a substituent of at least about 10 aliphatic carbon atoms. In one embodiment, the composition further comprises (D) an alkali or alkaline earth metal salt of an organic sulfur acid, a carboxylic acid or a phenol. In one embodiment, the composition further comprises (E) an alkali or alkaline earth metal salt of a hydrocarbon-substituted saligenin. In one embodiment, the composition further comprises (F) a metal salt of a phosphorus-containing compound. In one embodiment, the composition further comprises (G) a dispersant viscosity index modifier.

In one embodiment, the composition further comprises (H) one or more additional optional additives. The inventive composition may be made by blending components (A) and (B), and optionally one or more of components (C) to (H), using known blending techniques and any order of mixing or addition.

DESCRIPTION OF THE PREFERRED EMBODIMENTS

The term "hydrocarbyl" denotes a group having a carbon atom directly attached to the remainder of the molecule and having a hydrocarbon or predominantly hydrocarbon character within the context of this invention. Such groups include the following:

(1) Purely hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which do not alter the predominantly hydrocarbon character of the group. Those skilled in the art will be aware of suitable substituents. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The terms "hydrocarbon" and "hydrocarbon-based" have the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

The term "TBN" refers to total base number. This is the amount of acid (perchloric or hydrochloric) needed to neutralize all or part of a material's basicity, expressed as milligrams of KOH per gram of sample.

The Lubricating Oil Composition

The inventive lubricating oil composition is comprised of one or more base oils which are generally present in a major amount (i.e. an amount greater than about 50% by weight). Generally, the base oil is present in an amount greater than about 60%, or greater than about 70%, or greater than about 75% by weight of the lubricating oil composition.

The inventive lubricating oil composition may have a viscosity of up to about 16.3 cSt at 100° C., and in one embodiment about 5 to about 16.3 cSt at 100° C., and in one embodiment about 6 to about 13 cSt at 100° C.

The inventive lubricating oil composition may have an SAE Viscosity Grade of 0W, 0W-20, 0W-30, 0W40, 0W-50, 0W-60, 5W, 5W-20, 5W-30, 5W-40, 5W-50, 5W-60, 10W, 10W-20, 10W-30, 10W40 or 10W-50.

The inventive lubricating oil composition is characterized by a sulfur content of about 0.01 to about 0.25% by weight, and in one embodiment about 0.02 to about 0.25% by weight, and in one embodiment about 0.03 to about 0.25% by weight, and in one embodiment about 0.04 to about 0.25% by weight, and in one embodiment about 0.05 to about 0.25%, and in one embodiment about 0.07 to about 0.25% by weight, and in one embodiment about 0.10 to about 0.25% by weight, and in one embodiment about 0.01 to about 0.20% by weight, and in one embodiment about 0.02 to about 0.20% by weight, and in one embodiment about 0.03 to about 0.20% by weight, and in one embodiment about 0.04 to about 0.20% by weight, and in one embodiment about 0.05 to about 0.20% by weight, and in one embodiment about 0.07 to about 0.20% by weight, and in one embodiment about 0.10 to about 0.20% by weight, and in one embodiment about 0.15 to about 0.20% by weight, and in one embodiment about 0.17% by weight, and in one embodiment about 0.01 to about 0.15% by weight, and in one embodiment about 0.02 to about 0.15% by weight, and in one embodiment about 0.03 to about 0.15% by weight, and in one embodiment about 0.04 to about 0.15% by weight, and in one embodiment about 0.05 to about 0.15% by weight, and in one embodiment about 0.07 to about 0.15% by weight, and in one embodiment about 0.10 to about 0.15% by weight.

The inventive lubricating oil composition is characterized by a phosphorus content in the range of about 0.02 to about 0.14% by weight, and in one embodiment about 0.05 to about 0.14% by weight, and in one embodiment about 0.08 to about 0.14% by weight, and in one embodiment about 0.10 to about 0.14% by weight.

The ash content of the inventive lubricating oil composition as determined by the procedures in ASTM D-874-96 may be in the range of about 0.3 to about 1.4% by weight, and in one embodiment about 0.3 to about 1.2% by weight, and in one embodiment about 0.3 to about 1.1% by weight, and in one embodiment about 0.5 to about 1.1% by weight, and in one embodiment about 0.7 to about 1.1% by weight, and in one embodiment about 0.8 to about 1.0% by weight.

In one embodiment, the inventive lubricating oil composition is characterized by a chlorine content of up to about 100 ppm, and in one embodiment up to about 50 ppm, and in one embodiment up to about 30 ppm, and in one embodiment up to about 10 ppm.

The inventive lubricating oil compositions are characterized by reduced sulfur levels when compared to those in the prior art, and yet, at least in one embodiment, exhibit antiwear properties that are sufficient to pass industry standard tests for antiwear. The inventive lubricating oil compositions are especially suitable for use as engine lubricating oil compositions.

(A) The Base Oil

The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Groups I, II and III are mineral oil base stocks.

The base oil used in the inventive lubricating oil composition may be a natural oil, synthetic oil or mixture thereof, provided the sulfur level in such base oil is sufficiently low enough so that the sulfur level in the inventive lubricating oil composition does not exceed the above indicated concentration level required for the inventive lubricating oil composition. The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

The base oil may be a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. These PAOs may have a viscosity from about 2 to about 15, or from about 3 to about 12, or from about 4 to about 8 cSt at 100° C. Examples of useful PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. These hydrocarbons typically require further processing in order to be useful as the base oil. For example, the hydrocarbons may be hydroisomerized using the process disclosed in U.S. Pat. Nos. 6,103,099 or 6,180,575; hydrocracked and hydroisomerized using the process disclosed in U.S. Pat. Nos. 4,943,672 or 6,096,940; dewaxed using the process disclosed in U.S. Pat. No. 5,882,505; or hydroisomerized and dewaxed using the process disclosed in U.S. Pat. Nos. 6,013,171, 6,080,301 or 6,165,949. These patents are incorporated herein by reference for their disclosures of processes for treating Fischer-Tropsch synthesized hydrocarbons and the resulting products made from such processes.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(B) Phosphorus-Containing Compound

The phosphorus-containing compound (B) is a compound represented by the formula:

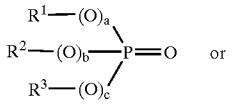

(B-I)

-continued

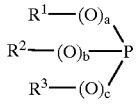

(B-II)

wherein in Formulae (B-I) and (B-II), $R^1$, $R^2$ and $R^3$ are independently hydrogen or hydrocarbyl groups, and a, b and c are independently zero or 1. The phosphorus-containing compound (B) can be a phosphate, phosphonate, phosphinate or phosphine oxide. The phosphorus-containing compound (B) can be a phosphite, phosphonite, phosphinite or phosphine. The phosphorus-containing compound can be a mixture of two or more of any of the foregoing.

The total number of carbon atoms in $R^1$, $R^2$ and $R^3$ in Formulae (B-I) and (B-II) must be sufficient to render the compound soluble in the base oil (A). Generally, the total number of carbon atoms in $R^1$, $R^2$ and $R^3$ is at least about 8, and in one embodiment at least about 10, and in one embodiment at least about 12. There is no limit to the total number of carbon atoms in $R^1$, $R^2$ and $R^3$ that is required, but a practical upper limit is about 400 or about 500 carbon atoms. In one embodiment, $R^1$, $R^2$ and $R^3$ are independently hydrocarbyl groups of 1 to about 100 carbon atoms, and in one embodiment 1 to about 50 carbon atoms, and in one embodiment 1 to about 30 carbon atoms, with the proviso that the total number of carbons in $R^1$, $R^2$ and $R^3$ is at least about 8. Each $R^1$, $R^2$ and $R^3$ may be the same as the other, although they may be different. Examples of useful $R^1$, $R^2$ and $R^3$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like. In one embodiment, the phosphorus-containing compound (B) is represented by the Formula (B-I) wherein each $R^1$, $R^2$ and $R^3$ is an alkyl aromatic (e.g., alkyl phenyl) group, and a, b and c are each 1. In one embodiment, the phosphorus-containing compound (B) is represented by the Formula (B-II) wherein each $R^1$, $R^2$ and $R^3$ is an aromatic (e.g., phenyl) group, and a, b and c are each 1.

The phosphorus compounds represented by Formulae (B-I) and (B-II) can be prepared by reacting a phosphorus acid or anhydride with an alcohol or mixture of alcohols corresponding to $R^1$, $R^2$ and $R^3$ in Formulae (B-I) or (B-II). The phosphorus acid or anhydride is generally an inorganic phosphorus reagent such as phosphorus pentoxide, phosphorus trioxide, phorphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

A useful phosphorus-containing compound is available from FMC under the trade designation Durad 310M which is identified as a tri (alkyl phenol) phosphate. Another useful compound is triphenyl phosphite.

The phosphorus-containing compound (B) may be employed in the inventive lubricating oil composition at a concentration in the range of about 0.2 to about 1.5% percent by weight, and in one embodiment about 0.4% to about 1% by weight, and in one embodiment about 0.5 to about 0.8% by weight. These compounds can be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., $C_{10}$–$C_{13}$ alkyl)

benzene, toluene or xylene to form an additive concentrate. These concentrates usually contain from about 1% to about 99% by weight, and in one embodiment about 10% to about 90% by weight of the diluent.

(C) Acylated Nitrogen-Containing Compound

In one embodiment, the inventive lubricating oil composition further comprises an acylated nitrogen-containing compound having a substituent of at least about 10 aliphatic carbon atoms. These compounds typically function as ashless dispersants in lubricating oil compositions.

A number of acylated, nitrogen-containing compounds having a substituent of at least about 10 aliphatic carbon atoms and made by reacting a carboxylic acid acylating agent with an amino compound are known to those skilled in the art. In such compositions the acylating agent is linked to the amino compound through an imido, amido, amidine or salt linkage. The substituent of at least about 10 aliphatic carbon atoms may be in either the carboxylic acid acylating agent derived portion of the molecule or in the amino compound derived portion of the molecule. In one embodiment, it is in the acylating agent portion. The acylating agent can vary from formic acid and its acyl derivatives to acylating agents having high molecular weight aliphatic substituents of up to about 5,000, 10,000 or 20,000 carbon atoms. The amino compounds are characterized by the presence within their structure of at least one HN<group.

In one embodiment, the acylating agent is a mono- or polycarboxylic acid (or reactive equivalent thereof) such as a substituted succinic or propionic acid and the amino compound is a polyamine or mixture of polyamines, most typically, a mixture of ethylene polyamines. The amine also may be a hydroxyalkyl-substituted polyamine. The aliphatic substituent in such acylating agents is a hydrocarbon-based group that typically averages at least about 30 or at least about 50 and up to about 400 carbon atoms.

Illustrative hydrocarbon based groups containing at least 10 carbon atoms are n-decyl, n-dodecyl, tetrapropylene, n-octadecyl, oleyl, chlorooctadecyl, triicontanyl, etc. Generally, the hydrocarbon-based substituents are made from homo- or interpolymers (e.g., copolymers, terpolymers) of mono- and di-olefins having 2 to 10 carbon atoms, such as ethylene, propylene, 1-butene, isobutene, butadiene, isoprene, 1-hexene, 1-octene, etc. Typically, these olefins are 1-monoolefins. The substituent can also be derived from the halogenated (e.g., chlorinated or brominated) analogs of such homo- or interpolymers. The substituent can, however, be made from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

The hydrocarbon-based substituents are substantially saturated, that is, they contain no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of 6 or less carbon atoms for every 10 carbon atoms in the substituent. Usually, however, the substituents contain no more than one such non-aliphatic group for every 50 carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than about 30 carbon atoms are the following:

- a mixture of poly(ethylene/propylene) groups of about 35 to about 70 carbon atoms;
- a mixture of the oxidatively or mechanically degraded poly(ethylene/propylene) groups of about 35 to about 70 carbon atoms;
- a mixture of poly(propylene/1-hexene) groups of about 80 to about 150 carbon atoms;
- a mixture of poly(isobutene) groups having an average of about 50 to about 200 carbon atoms.

A useful source of the hydrocarbon-based substituents are poly(isobutene)s obtained by polymerization of a $C_4$ refinery stream having a butene content of about 35 to about 75 weight percent and isobutene content of about 30 to about 60 weight percent in the presence of a Lewis acid catalyst such as aluminum trichloride or boron trifluoride. These polybutenes contain predominantly (greater than 80% of total repeating units) isobutene repeating units of the configuration:

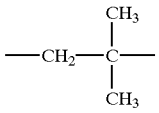

In one embodiment, the substituent is a polyisobutene group derived from a polyisobutene having a high methylvinylidene isomer content, that is, at least about 70% methylvinylidene, and in one embodiment at least about 80% methylvinylidene. Suitable high methylvinylidene polyisobutenes include those prepared using boron trifluoride catalysts. The preparation of such polyisobutenes in which the methylvinylidene isomer comprises a high percentage of the total olefin composition is described in U.S. Pat. Nos. 4,152,499 and 4,605,808, the disclosures of each of which are incorporated herein by reference.

In one embodiment, the carboxylic acid acylating agent is a hydrocarbon substituted succinic acid or anhydride. The substituted succinic acid or anhydride consists of hydrocarbon-based substituent groups and succinic groups wherein the substituent groups are derived from a polyalkene, said acid or anhydride being characterized by the presence within its structure of an average of at least about 0.9 succinic group for each equivalent weight of substituent groups, and in one embodiment about 0.9 to about 2.5 succinic groups for each equivalent weight of substituent groups. The polyalkene generally has number average molecular weight ($\overline{M}n$) of at least about 700, and in one embodiment about 700 to about 2000, and in one embodiment about 900 to about 1800. The ratio between the weight average molecular weight ($\overline{M}w$) and the ($\overline{M}n$) (that is, the $\overline{M}w/\overline{M}n$) can range from about 1 to about 10, or about 1.5 to about 5. In one embodiment the polyalkene has an $\overline{M}w/\overline{M}n$ value of about 2.5 to about 5. For purposes of this invention, the number of equivalent weights of substituent groups is deemed to be the number corresponding to the quotient obtained by dividing the $\overline{M}n$ value of the polyalkene from which the substituent is derived into the total weight of the substituent groups present in the substituted succinic acid. Thus, if a substituted succinic acid is characterized by a total weight of substituent group of 40,000 and the $\overline{M}n$ value for the polyalkene from which the substituent groups are derived is 2000, then that substituted succinic acylating agent is characterized by a total of 20 (40,000/2000=20) equivalent weights of substituent groups.

In one embodiment the carboxylic acid acylating agent is a substituted succinic acid or anhydride, said substituted succinic acid or anhydride consisting of hydrocarbon-based substituent groups and succinic groups wherein the substituent groups are derived from polybutene in which at least about 50% of the total units derived from butenes is derived from isobutylene. The polybutene is characterized by an $\overline{M}n$ value of about 1500 to about 2000 and an $\overline{M}w/\overline{M}n$ value of about 3 to about 4. These acids or anhydrides are characterized by the presence within their structure of an average of about 1.5 to about 2.5 succinic groups for each equivalent weight of substituent groups.

In one embodiment the carboxylic acid is at least one substituted succinic acid or anhydride, said substituted succinic acid or anhydride consisting of substituent groups and succinic groups wherein the substituent groups are derived from polybutene in which at least about 50% of the total units derived from butenes is derived from isobutylene. The polybutene has an $\overline{M}n$ value of about 800 to about 1200 and an $\overline{M}w/\overline{M}n$ value of about 2 to about 3. The acids or anhydrides are characterized by the presence within their structure of an average of about 0.9 to about 1.2 succinic groups for each equivalent weight of substituent groups.

The amino compound is characterized by the presence within its structure of at least one HN<group and can be a monoamine or polyamine. Mixtures of two or more amino compounds can be used in the reaction with one or more acylating reagents. In one embodiment, the amino compound contains at least one primary amino group (i.e., $—NH_2$) and more preferably the amine is a polyamine, especially a polyamine containing at least two —NH— groups, either or both of which are primary or secondary amines. The amines may be aliphatic, cycloaliphatic, aromatic or heterocyclic amines.

Among the useful amines are the alkylene polyamines, including the polyalkylene polyamines. The alkylene polyamines include those conforming to the formula:

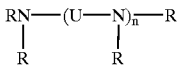

wherein n is from 1 to about 14; each R is independently a hydrogen atom, a hydrocarbyl group or a hydroxy-substituted or amine-substituted hydrocarbyl group having up to about 30 atoms, or two R groups on different nitrogen atoms can be joined together to form a U group, with the proviso that at least one R group is a hydrogen atom and U is an alkylene group of about 2 to about 10 carbon atoms. U may be ethylene or propylene. Alkylene polyamines where each R is hydrogen or an amino-substituted hydrocarbyl group with the ethylene polyamines and mixtures of ethylene polyamines are useful. Usually n will have an average value of from about 2 to about 10. Such alkylene polyamines include methylene polyamine, ethylene polyamines, propylene polyamines, butylene polyamines, pentylene polyamines, hexylene polyamines, heptylene polyamines, etc. The higher homologs of such amines and related amino alkyl-substituted piperazines are also included.

Alkylene polyamines that are useful include ethylene diamine, triethylene tetramine, propylene diamine, trimethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2% by weight, usually less than 1% by weight material boiling below about 200° C. In the instance of ethylene polyamine bottoms, which are readily available and found to be quite useful, the bottoms contain less than about 2% by weight total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample indicates it contains about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Other polyamines are described in, for example, U.S. Pat. Nos. 3,219,666 and 4,234,435, and these patents are hereby incorporated by reference for their disclosures of amines which can be reacted with the acylating agents described above to form useful acylated nitrogen-containing compounds.

In one embodiment, the amine may be a hydroxyamine. Typically, the hydroxyamines are primary or secondary alkanol amines or mixtures thereof. Such amines can be represented by the formulae:

$$H_2N—R'—OH \text{ or } RN(H)—R'—OH$$

wherein R is a hydrocarbyl group of one to about eight carbon atoms or hydroxyhydrocarbyl group of two to about eight carbon atoms, and in one embodiment one to about four, and R' is a divalent hydrocarbyl group of about two to about 18 carbon atoms, and in one embodiment two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Typically, each R is independently a methyl, ethyl, propyl, butyl, pentyl or hexyl group.

Examples of these alkanolamines include mono- and di-ethanol amine, ethylethanolamine, etc.

The hydroxyamines can also be an ether N-(hydroxyhydrocarbyl)-amine. These are hydroxypoly (hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with afore-described amines and can be represented by the formulae:

$$H_2N—(R'O)_x—H \text{ or } RN(H)—(R'O)_xH$$

wherein x is a number from about 2 to about 15 and R and R' are as described above. R may also be a hydroxypoly (hydrocarbyloxy) group.

The acylated nitrogen-containing compounds include amine salts, amides, imides, amidines, amidic acids, amidic salts and imidazolines as well as mixtures thereof. To prepare the acylated nitrogen-containing compounds from the acylating reagents and the amino compounds, one or more acylating reagents and one or more amino compounds are heated, optionally in the presence of a normally liquid, substantially inert organic liquid solvent/diluent, at temperatures in the range of about 80° C. up to the decomposition point of either the reactants or the carboxylic derivative but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from about one-half equivalent up to about 2 moles of amino compound per equivalent of acylating reagent.

Many patents have described useful acylated nitrogen-containing compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763; and 4,234,435. A typical acylated nitrogen-containing compound of this class is that made by reacting a poly(isobutene)-substituted succinic acid acylating agent (e.g., anhydride, acid, ester, etc.) wherein the poly (isobutene) substituent has between about 50 to about 400 carbon atoms with a mixture of ethylenepolyamines having about 3 to about 7 amino nitrogen atoms per ethylenepolyamine and about 1 to about 6 ethylene units. The above-noted U.S. patents are hereby incorporated by reference for their disclosure of acylated amino compounds and their method of preparation.

Another type of acylated nitrogen-containing compound belonging to this class is that made by reacting a carboxylic acid acylating agent with a polyamine, wherein the polyamine is the product made by condensing a hydroxy material with an amine. These compounds are described in U.S. Pat. No. 5,053,152 which is incorporated herein by reference for its disclosure of such compounds.

Another type of acylated nitrogen-containing compound belonging to this class is that made by reacting the afore-described alkyleneamines with the afore-described substituted succinic acids or anhydrides and aliphatic monocarboxylic acids having from 2 to about 22 carbon atoms. In these types of acylated nitrogen compounds, the mole ratio of succinic acid to monocarboxylic acid ranges from about 1:0.1 to about 1:1. Typical of the monocarboxylic acid are formic acid, acetic acid, dodecanoic acid, butanoic acid, oleic acid, stearic acid, the commercial mixture of stearic acid isomers known as isostearic acid, tall oil acid, etc. Such materials are more fully described in U.S. Pat. Nos. 3,216,936 and 3,250,715 which are hereby incorporated by reference for their disclosures in this regard.

Still another type of acylated nitrogen-containing compound that may be useful is the product of the reaction of a fatty monocarboxylic acid of about 12–30 carbon atoms and the afore-described alkyleneamines, typically, ethylene-, propylene- or trimethylenepolyamines containing 2 to 8 amino groups and mixtures thereof. The fatty monocarboxylic acids are generally mixtures of straight and branched chain fatty carboxylic acids containing 12–30 carbon atoms. A widely used type of acylated nitrogen compound is made by reacting the afore-described alkylenepolyamines with a mixture of fatty acids having from 5 to about 30 mole percent straight chain acid and about 70 to about 95% mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chloro-stearic acids. Branched chain fatty carboxylic acid/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are hereby incorporated by reference for their disclosure of fatty acid/polyamine condensates for use in lubricating oil formulations.

In one embodiment, the lubricating oil composition is characterized by a chlorine level of up to about 100 ppm, and in one embodiment up to about 50 ppm, and in one embodiment up to about 30 ppm, and in one embodiment up to about 10 ppm. This necessitates that the acylated nitrogen-containing compound be derived from a reaction product that is chlorine-free or contains such low chlorine levels that the addition of such compound to the lubricating oil composition results in the formation of a lubricating oil composition with the above-indicated chlorine level. In one embodiment, the acylated nitrogen-containing compound is contained in or derived from a reaction product that has a chlorine content of no more than about 50 ppm, and in one embodiment no more than about 25 ppm, and in one embodiment no more than about 10 ppm. In one embodiment, the acylated nitrogen-containing compound is contained in or derived from a reaction product that is chlorine free.

The acylated nitrogen-containing compound (C) may be employed in the inventive lubricating oil composition at a concentration in the range of up to about 10% by weight, and in one embodiment about 1 to about 10% percent by weight, and in one embodiment about 2% to about 5% by weight, and in one embodiment about 2 to about 3% by weight. These compounds can be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., $C_{10}$–$C_{13}$ alkyl) benzene, toluene or xylene to form an additive concentrate. These concentrates usually contain from about 1% to about 99% by weight, and in one embodiment about 10% to about 90% by weight of the diluent.

(D) Alkali or Alkaline Earth Metal Salt of Organic Sulfur Acid, Carboxylic Acid, Lactone or Phenol The alkali metal or alkaline earth metal salts (D) are salts of organic sulfur acids, carboxylic acids, lactones or phenols. These salts may be neutral or overbased. The former contain an amount of metal cation just sufficient to neutralize the acidic groups present in the salt anion; the latter contain an excess of metal cation and are often termed basic, hyperbased or superbased salts.

The terminology "metal ratio" is used herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and, in an overbased salt, the metal ratio is greater than one. The overbased salts used as component (D) in this invention may have metal ratios of at least about 1.2:1, and in one embodiment at least about 1.4:1. Often they have ratios of at least about 2:1, and in one embodiment at least about 4:1. These salts may have metal ratios not exceeding about 20:1. Salts having ratios of about 1.5:1 to about 15:1 may be used.

The organic sulfur acids are oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids.

The sulfonic acids include the mono- or poly-nuclear aromatic or cycloaliphatic compounds. The sulfonic acids may be represented for the most part by one of the following formulae:

$$R^1(SO_3H)_r \quad \text{(D-I)}$$

$$(R^2)_xT(SO_3H)_y \quad \text{(D-II)}$$

wherein in Formulae (D-I) and (D-II), T is an aromatic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, etc; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater. Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to about 7000 or more carbon atoms. The groups T, $R^1$, and $R^2$ in the above formulae can also contain other inorganic or organic substituents in addition to those enumerated above such as, for example, hydroxy, mercapto, halogen, nitro, amino, nitroso, sulfide, disulfide, etc. The subscript x is generally 1–3, and the subscripts r and y generally have an average value of about 1–4 per molecule.

The following are specific examples of oil-soluble sulfonic acids coming within the scope of Formulae (D-I) and (D-II), and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids include mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkylbenzene sulfonic acids (where the alkyl group has at least 8 carbons), cetylphenol monosulfide sulfonic acids, dicetyl thianthrenedisulfonic acids, dilaurylbetanaphthylsulfonic acids, and alkaryl sulfonic acids such as dodecylbenzene "bottoms" sulfonic acids.

The latter are acids derived from benzene which has been alkylated with propylene tetramers or isobutene trimers to introduce 1, 2, 3, or more branched-chain $C_{12}$ substituents on the benzene ring. Dodecylbenzene bottoms, principally mixtures of mono- and di-dodecylbenzenes, are available as by-products from the manufacture of household detergents. Similar products obtained from alkylation bottoms formed during manufacture of linear alkylsulfonates (LAS) are also useful in making the sulfonates used in this invention.

The production of sulfonates from detergent manufacture byproducts is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790; and 3,798,012. These are hereby incorporated by reference for their disclosures in this regard. Also included are aliphatic sulfonic acids such as paraffin wax sulfonic acids, unsaturated paraffin wax sulfonic acids, hydroxy-substituted paraffin wax sulfonic acids, hexapropylenesulfonic acids, tetraamylene sulfonic acids, polyisobutenesulfonic acids wherein the polyisobutene contains from 20 to 7000 or more carbon atoms, chloro-substituted paraffin wax sulfonic acids, nitro-paraffin wax sulfonic acids, etc; cycloaliphatic sulfonic acids such as petroleum naphthenesulfonic acids, cetylcyclopentyl sulfonic acids, laurylcyclohexylsulfonic acids, bis(di-isobutyl)cyclohexyl sulfonic acids, mono- or poly-wax substituted cyclohexylsulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

The carboxylic acids from which suitable neutral and basic alkali metal and alkaline earth metal salts (D) may be made include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least about 8 carbon atoms, and in one embodiment at least about 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, alpha-linolenic acid, propylenetetramer-substituted maleic acid, behenic acid, isostearic acid, pelargonic acid, capric acid, palmitoleic acid, linoleic acid, lauric acid, oleic acid, ricinoleic acid, decanoic acid, undecanoic acid, dioctylcyclopentane carboxylic acid, myristic acid, dilauryldecahydro-naphthalene carboxylic acid, stearyl-octahydroindene carboxylic acid, palmitic acid, and commercially available mixtures of two or more carboxylic acids such as tall oil acids, rosin acids, and the like.

A useful group of oil-soluble carboxylic acids useful in preparing the salts used in the present invention are the oil-soluble aromatic carboxylic acids. These acids are represented by the formula:

$$(R^*)_a—Ar^*(CXXH)_m \qquad \text{(D-III)}$$

wherein in Formula (D-III), R* is an aliphatic hydrocarbon-based group of at least 4 carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula (D-III). Examples of aromatic nuclei represented by the variable Ar* are the polyvalent aromatic radicals derived from benzene, naphthalene, anthracene, phenanthrene, indene, fluorene, biphenyl, and the like. Generally, the group represented by Ar* will be a polyvalent nucleus derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups in Formula (D-III) are usually purely hydrocarbyl groups, including groups such as alkyl or alkenyl radicals. However, the R* groups may contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 2-hexenyl, e-cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

A group of useful carboxylic acids are those of the formula:

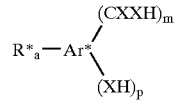

(D-IV)

wherein in Formula (D-IV), R*, X, Ar*, m and a are as defined in Formula (D-III) and p is an integer of 1 to 4, usually 1 or 2. Within this group, a useful class of oil-soluble carboxylic acids are those of the formula:

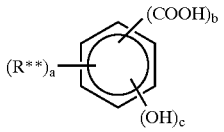

(D-V)

wherein in Formula (D-V), R is an aliphatic hydrocarbon group containing at least 4 to about 400 carbon atoms, a is an integer of from 1 to 3, b is 1 or 2, c is zero, 1, or 2 and in one embodiment 1 with the proviso that R and a are such that the acid molecules contain at least an average of about 12 aliphatic carbon atoms in the aliphatic hydrocarbon substituents per acid molecule. And within this latter group of oil-soluble carboxylic acids, the aliphatic-hydrocarbon substituted salicylic acids wherein each aliphatic hydrocarbon substituent contains an average of at least about 8 carbon atoms, and in one embodiment at least about 16 carbon atoms per substituent and one to three substituents per molecule are particularly useful. A useful aliphatic-hydrocarbon substituted salicylic acid is $C_{16}$–$C_{18}$ alkyl salicylic acid. Salts prepared from aliphatic-hydrocarbon substituted salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms may be used.

Carboxylic acids of the type illustrated by the above formulae and processes for preparing their neutral and basic metal salts are well known and disclosed, for example, in such U.S. Patent as U.S. Pat. Nos. 2,197,832; 2,197,835; 2,252,662; 2,252,664; 2,714,092; 3,410,798 and 3,595,791, which are incorporated herein by reference.

Another type of neutral and basic carboxylate salt used in this invention are those derived from hydrocarbon substituted succinic acids of the general formula

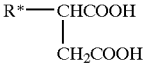

(D-VI)

wherein in Formula (D-VI), R* is as defined above in Formula (D-III). Such salts are set forth in U.S. Pat. Nos. 3,271,130; 3,567,637 and 3,632,610, which are hereby incorporated by reference in this regard.

Patents describing techniques for making basic salts of sulfonic acids and/or carboxylic acids include U.S. Pat. Nos. 2,501,731; 2,616,904; 2,616,905; 2,616,906; 2,616,911; 2,616,924; 2,616,925; 2,617,049, 2,777,874; 3,027,325; 3,256,186; 3,282,835; 3,384,585; 3,373,108; 3,368,396;

3,342,733; 3,320,162; 3,312,618; 3,318,809; 3,471,403; 3,488,284; 3,595,790; and 3,629,109. The disclosures of these patents are hereby incorporated by reference in the present specification.

A group of carboxylic acid derivatives that are useful are the lactones represented by the formula:

(D-VII)

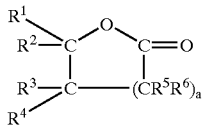

wherein in Formula (D-VII), $R^1$, $R^2$, $R^3$, $R^4$, $R^5$ and $R^6$ are independently H, hydrocarbyl groups or hydroxy substituted hydrocarbyl groups of from 1 to about 30 carbon atoms, with the proviso that the total number of carbon atoms must be sufficient to render the lactones oil soluble; $R^2$ and $R^3$ can be linked together to form an aliphatic or aromatic ring; and a is a number in the range of zero to about 4. Within this group the lactones represented by the following formula are useful:

(D-VIII)

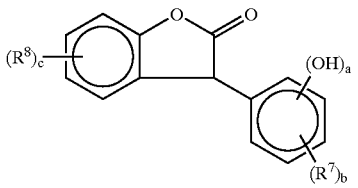

wherein in Formula (D-VIII), $R^7$ and $R^8$ are aliphatic hydrocarbyl groups of from 1 to about 30 carbon atoms, a and b are numbers in the range of zero to 5 with the proviso that the sum of a and b does not exceed 5, and c is a number in the range of zero to 4. The procedures for preparing lactones of this type through intramolecular cyclization of hydroxy-containing carboxylic acids accompanied by the elimination of water are well known in the art. Generally, the cyclization is promoted by the presence of materials such as acetic anhydride, and the reaction is effected by heating the mixtures to elevated temperatures such as the reflux temperature while removing volatile materials including water. A useful lactone can be prepared by reacting an alkyl (e.g., dodecyl) phenol with glyoxylic acid at a molar ratio of 2:1.

Neutral and basic salts of phenols (generally known as phenates) are also useful in the compositions of this invention and well known to those skilled in the art. The phenols from which these phenates are formed are of the general formula:

$$(R^*)_a—(Ar^*)—(OH)_m \qquad \text{(D-IX)}$$

wherein in Formula (D-IX), R*, a, Ar*, and m have the same meaning and preferences as described hereinabove with reference to Formula (D-III). The same examples described with respect to Formula (D-III) also apply.

A commonly available class of phenates are those made from phenols of the general formula:

(D-X)

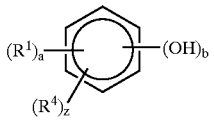

wherein in Formula (D-X), a is an integer of 1–3, b is of 1 or 2, z is 0 or 1, $R^1$ is a substantially saturated hydrocarbon-based substituent having an average of from about 30 to about 400 aliphatic carbon atoms and $R^4$ is selected from the group consisting of lower alkyl, lower alkoxyl, nitro, and halo groups.

A class of phenates for use in this invention are the basic (i.e., overbased, etc.) alkali and alkaline earth metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971 and 3,775,321 which are hereby incorporated by reference for their disclosures in this regard.

Other phenates that are useful are those that are made from phenols that have been linked through alkaline (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Mixtures of two or more neutral and basic salts of the hereinabove described organic sulfur acids, carboxylic acids and phenols can be used in the compositions of this invention.

The alkali and alkaline earth metals that are useful include sodium, potassium, lithium, calcium, magnesium, strontium and barium, with calcium and magnesium being especially useful.

The metal salt (D) may be employed in the inventive lubricating oil composition at a concentration in the range of up to about 5% by weight, and in one embodiment about 0.5 to about 5% percent by weight, and in one embodiment about 1% to about 2.5% by weight. These compounds can be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., $C_{10}$–$C_{13}$ alkyl)benzene, toluene or xylene to form an additive concentrate. These concentrates usually contain from about 1% to about 99% by weight, and in one embodiment about 10% to about 90% by weight of the diluent.

(E) Alkali or Alkaline Earth Metal Salt of a Hydrocarbon-Substituted Saligenin

The alkali or alkaline earth metal salt of a hydrocarbon-substituted saligenin may be a compound represented by the formula:

(E-I)

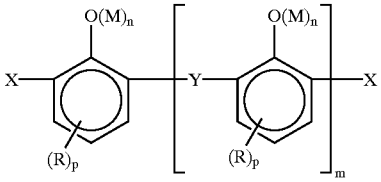

wherein in Formula (E-I): each X independently is —CHO or —$CH_2OH$; each Y independently is —$CH_2$— or —$CH_2OCH_2$—; wherein the —CHO groups comprise at least about 10 mole percent of the X and Y groups; each M is independently a valence of an alkali or alkaline earth metal ion; each R is independently a hydrocarbyl group containing 1 to about 60 carbon atoms; m is 0 to about 10; n is 0 or 1 provided that when n is 0 the M is replaced with H; and each p is independently 0, 1, 2, or 3; provided that at least one aromatic ring contains an R substituent and that the total number of carbon atoms in all R groups is at least 7; and further provided that if m is 1 or greater, then one of the X groups can be —H.

The alkali and alkaline earth metals that are useful include sodium, potassium, lithium, calcium, magnesium, strontium and barium, with calcium and magnesium being especially useful. In Formula (E-I), when the metal M is a divalent metal (e.g., calcium or magnesium) the other valence of M, not shown, may be satisfied by other anions or by association with an additional —$O^-$ functionality of the same saligenin derivative.

In Formula (E-I), each n is independently 0 or 1, provided that when n is 0, the M is replaced by H, that is, to form an unneutralized phenolic —OH group. The average value of n is typically about 0.1 to about 1.0. That is, the structure represents a partially or completely neutralized metal salt, a value of 1.0 corresponding to complete neutralization of each site by the metal ion M. The compound contains one aromatic ring or a multiplicity of aromatic rings linked by "Y" groups, and also "X" groups. Since "m" can be 0 to about 10, this means that the number of such rings will typically be 1 to about 11, although it is to be understood that the upper limit of "m" is not a critical variable. In one embodiment, m is about 2 to about 9, and in one embodiment about 3 to about 8, and in one embodiment about 4 to about 6. If m is 1 or greater, then one of the X groups can be —H.

Most of the aromatic rings in Formula (E-I) contain at least one R substituent, which is a hydrocarbyl group, and in one embodiment an alkyl group, containing 1 to about 60 carbon atoms, and in one embodiment about 7 to about 28 carbon atoms, and in one embodiment about 9 to about 18 carbon atoms. R may comprise a mixture of various chain lengths, so that the foregoing numbers represent an average number of carbon atoms in the R groups (number average). R can be linear or branched. Each aromatic ring in the structure may be substituted with 0, 1, 2, or 3 such R groups (that is, p is 0, 1, 2, or 3), most typically 1. Different rings in a given molecule may contain different numbers of such substituents. At least one aromatic ring in the molecule must contain at least one R group, and the total number of carbon atoms in all the R groups in the molecule should be at least about 7, and in one embodiment at least about 12.

In Formula (E-I), the X and Y groups may be seen as groups derived from formaldehyde or a formaldehyde source, by condensative reaction with the aromatic molecule. While various species of X and Y may be present, the commonest species comprising X are —CHO (aldehyde functionality) and —$CH_2OH$ (hydroxymethyl functionality); similarly the commonest species comprising Y are —$CH_2$— (methylene bridge) and —$CH_2OCH_2$— (ether bridge). The relative molar amounts of these species in a sample of the above material may be determined by $^1H/^{13}C$ NMR as each carbon and hydrogen nucleus has a distinctive environment and produces a distinctive signal. (The signal for the ether linkage, —$CH_2OCH_2$— must be corrected for the presence of two carbon atoms, in order to arrive at a correct calculation of the molar amount of this material. Such a correction is well within the abilities of the person skilled in the art.)

In one embodiment, X is at least in part —CHO and such —CHO groups comprise at least about 10, and in one embodiment at least about 12, and in one embodiment at least about 15 mole percent of the X and Y groups. In one embodiment, the —CHO groups comprise about 20 to about 60 mole percent of the X and Y groups, and in one embodiment about 25 to about 40 mole percent of the X and Y groups.

In one embodiment, X is at least in part —$CH_2OH$ and such —$CH_2OH$ groups comprise about 10 to about 50 mole percent of the X and Y groups, and in one embodiment about 15 to about 30 mole percent of the X and Y groups.

In one embodiment in which m is non-zero, Y is at least in part —$CH_2$— and such —$CH_2$— groups comprise about 25 to about 55 mole percent of the X and Y groups, and in one embodiment about 32 to about 45 mole percent of the X and Y groups.

In one embodiment, Y is at least in part —$CH_2OCH_2$— and such —$CH_2OCH_2$— groups comprise about 5 to about 20 mole percent of the X and Y groups, and in one embodiment about 10 to about 16 mole percent of the X and Y groups.

The relative amounts of the various X and Y groups depends to a certain extent on the conditions of synthesis of the molecules. Under many conditions the amount of —$CH_2OCH_2$— groups is relatively small compared to the other groups and is reasonably constant at about 13 to about 17 mole percent. Ignoring the amount of such ether groups and focusing on the relative amounts of the —CHO, —$CH_2OH$, and —$CH_2$— groups, useful compositions have the following relative amounts of these three groups, the total of such amounts in each case being normalized to equal 100%:

| | | | | | |
|---|---|---|---|---|---|
| —CHO: | 15–100% | or | 20–60% | or | 25–50% |
| —$CH_2OH$: | 0–54% | or | 4–46% | or | 10–40% |
| —$CH_2$—: | 0–64% | or | 18–64% | or | 20–60% |

The compound represented by Formula (E-I) may be a magnesium salt, and the presence of magnesium during the preparation of the compound is believed to be important in achieving the desired ratios of X and Y components described above. (After preparation of the compound, the Mg metal can be replaced by hydrogen, other metals, or ammonium if desired, by known methods.) The number of Mg ions in the composition is characterized by an average value of "n" of about 0.1 to about 1.0, and in one embodiment about 0.2 or about 0.4 to about 0.9, and in one embodiment about 0.6 to about 0.8, which correspond to about 20% to about 100%, and in one embodiment about 20% or about 40% to about 90%, and in one embodiment about 60% to about 80% neutralization by Mg. Since Mg is normally a divalent ion, it can neutralize up to two phenolic hydroxy groups. Those two hydroxy groups may be on the same or on different molecules. If the value of n is less than 1.0, this indicates that the hydroxy groups are less than completely neutralized by Mg ions. Alternatively, each Mg ion may be associated with one phenolic anion and an ion of another type such as a hydroxy ($OH^-$) ion or carbonate ion ($CO_3^-$), while still providing an n value of 1.0. The specification that the average value of n is about 0.1 to about 1.0 is not directly applicable to basic or overbased versions of this material (described below) in which an excess of Mg or another cation can be present. It should be understood that, even in a basic material, some fraction of the phenolic OH groups may not have reacted with the magnesium and may retain the OH structure.

It is to be understood that in a sample of a large number of molecules, some individual molecules will exist which deviate from these parameters: for instance, there may be some molecules containing no R groups whatsoever. Likewise, some fraction of molecules may contain only one (or even zero) X groups, while some may contain more than two X groups. And some fraction of the aromatic groups may be linked by Y groups to more than two neighboring aromatic groups. These molecules could be considered as impurities, and their presence will not negate the present invention so long as the majority of the molecules of the composition are as described. In any event, compositions exhibiting this type of variability are to be construed as encompassed by the present invention and the description that a material is represented by the formula shown. There is a reasonable possibility that a significant fraction of the polynuclear molecules of the present invention may bear only a single X group. In order to explicitly account for this possibility, it is to be understood that if m is 1 or greater, one (but typically not both) of the X groups in the above structures can be —H.

The salts represented by Formula (E-I) can be prepared by combining a phenol substituted by the above-described R group with formaldehyde or a source of formaldehyde and magnesium oxide or magnesium hydroxide under reactive conditions, in the presence of a catalytic amount of a strong base.

Substituted phenols, and alkyl-substituted phenols in particular, are well known items of commerce. Alkylated phenols are described in greater detail in U.S. Pat. No. 2,777,874.

Formaldehyde and its equivalents are likewise well known. Common reactive equivalents of formaldehyde includes paraformaldehyde, trixoane, formalin and methal.

The relative molar amounts of the substituted phenol and the formaldehyde can be important in providing products with the desired structure and properties. In one embodiment, the substituted phenol and formaldehyde are reacted in equivalent ratios of about 1:1 to about 1:3 or about 1:4, and in one embodiment about 1:1.1 to about 1:2.9, and in one embodiment about 1:1.4 to about 1:2.6, and in one embodiment about 1:1.7 to about 1:2.3. Thus, in one embodiment, there is about a 2:1 equivalent ratio of formaldehyde to substituted phenol. (One equivalent of formaldehyde is considered to correspond to one $H_2CO$ unit; one equivalent of phenol is considered to be one mole of phenol.) In one embodiment of the Mg species, the mole ratio of alkylphenol:formaldehyde:Mg is about 1:1.4:0.4, that is, for example, about (1): (1.3 to 1.5): (0.3 to 0.5), the amounts being the quantities actually retained in the final product, rather than the amounts charged to the reaction.

The strong base may be sodium hydroxide or potassium hydroxide, and can be supplied in an aqueous solution.

The process can be conducted by combining the above components with an appropriate amount of magnesium oxide or magnesium hydroxide with heating and stirring. A diluent such as mineral oil or other diluent oil can be included to provide for suitable mobility of the components. An additional solvent such as an alcohol can be included if desired, although it is believed that the reaction may proceed more efficiently in the absence of additional solvent. The reaction can be conducted at room temperature or a slightly elevated temperature such as about 35 to about 120° C., and in one embodiment about 70 to about 110° C., and in one embodiment about 90 to about 100° C. The temperature may be increased in stages. When water is present in the reaction mixture it is convenient to maintain the mixture at or below the normal boiling point of water. After reaction for a suitable time (e.g., about 30 minutes to about 5 hours, or about 1 to about 3 hours) the mixture can be heated to a higher temperature, preferably under reduced pressure, to strip off volatile materials. Favorable results may be obtained when the final temperature of this stripping step is about 100 to about 150° C., and in one embodiment about 120 to about 145° C.

Reaction under the conditions described above leads to a product which has a relatively high content of —CHO substituent groups, that is, about 10%, about 12%, about 15%, or greater.

The hydrocarbon-substituted saligenin salt (E) may be overbased. When these salts are overbased, the stoichiometrically excess metal can be magnesium or it can be another metal or a mixture of cations. The basically reacting metal compounds used to make these overbased salts are usually an alkali or alkaline earth metal compound (i.e., the Group IA, IIA, and IIB metals excluding francium and radium and typically excluding rubidium, cesium and beryllium), although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art referred to herein. Overbased salts containing a mixture of ions of two or more of these metals or other cations, including mixtures of alkaline earth metals such as Mg and Ca, can be used.

Overbased materials are generally prepared by reacting an acidic material (typically an inorganic acid, e.g., carbon dioxide, or lower carboxylic acid) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the above-described saligenin derivative.

The acidic material used in preparing the overbased material can be a liquid such as formic acid, acetic acid, nitric acid, or sulfuric acid. Acetic acid is particularly useful. Gaseious acidic materials can also be used, such as HCl, $SO_2$, $SO_3$, $CO_2$, or $H_2S$, preferably $CO_2$ or mixtures thereof, e.g., mixtures of $CO_2$ and acetic acid. The acidic material, which may be an acidic gas, is reacted with the mixture under conditions to react, normally, with the majority of, or about 80-90% or about 85-90% of, the stoichiometric excess of the metal base. Strongly acidic materials, however, would normally be used in an amount less than an equivalent of the phenol, while weakly acidic materials such as $CO_2$ can be used in excess.

A promoter is a chemical employed to facilitate the incorporation of metal into the basic metal compositions.

The promoters are diverse and are well known in the art. A discussion of suitable promoters is found in U.S. Pat. Nos. 2,777,874, 2,695,910, and 2,616,904. These include the alcoholic and phenolic promoters. The alcoholic promoters include the alkanols of 1 to about 12 carbon atoms such as methanol, ethanol, amyl alcohol, octanol, isopropanol, and mixtures of these. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Patents describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The hydrocarbon-substituted saligenin salt (E) may be employed in the inventive lubricating oil composition at a concentration in the range of up to about 5% by weight, and in one embodiment about 0.5 to about 5% percent by weight, and in one embodiment about 1% to about 2.5% by weight. These compounds can be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., $C_{10}$–$C_{13}$alkyl) benzene, toluene or xylene to form an additive concentrate. These concentrates usually contain from about 1% to about 99% by weight, and in one embodiment about 10% to about 90% by weight of the diluent.

The following examples disclose the preparation of hydrocarbon-substituted saligenin salts that are useful in preparing the inventive lubricating oil composition. In the following examples as well as throughout the specification and claims, unless otherwise indicated, all parts and percentages are by weight and all temperatures are in degrees Celsius.

EXAMPLE E-1

To a 5-L, 4-necked round bottom flask equipped with stirrer, stopper, thermowell, and reflux condenser, the following are charged: 670 g diluent oil (mineral oil), 1000 g dodecyl phenol, and a solution of 3 g NaOH in 40 g water. The mixture is heated to 35° C. with stirring. When 35° C. is attained, 252 g of paraformaldehyde (90%) are added to the mixture and stirring is continued. After 5 minutes, 5 g of MgO and 102 g of additional diluent oil are added. The mixture is heated to 79° C. and held at temperature for 30 minutes. A second increment of 58 g MgO is added and the batch is further heated and maintained at 90–100° C. for 1 hour. Thereafter the mixture is heated to 120° C. under a flow of nitrogen at 28 L/Hr (1.0 std. $ft^3$/hr.). When 120° C. is reached, 252 g diluent oil is added, and the mixture is stripped at a pressure of 2.7 kPa (20 torr) at 120° C. for 1 hour and then filtered. The resulting product contains 1.5% by weight magnesium and has a TBN of 63. Analysis of the product by 1 D and 2D $^1H/^{13}C$ NMR reveals an aldehyde content of 29 mole %, a methylene bridge content of 38 mole %, an ether bridge content of 12 mole %, and a hydroxymethyl content of 21 mole %.

EXAMPLE E-2

Part A

To a 5-L, 4-necked round bottom flask equipped with stirrer, stopper, thermowell, and reflux condenser, the following are charged: 670 g diluent oil (mineral oil), and 1000 g dodecyl phenol. The mixture is heated to 35° C. with stirring. When 35° C. is attained, 252 g of paraformaldehyde (90%) are added to the mixture and stirring is continued. After 5 minutes, 7.3 g of $Ca(OH)_2$ and 102 g of additional diluent oil are added. The mixture is heated to 79° C. and held at temperature for 30 minutes. A second increment of 104 g of $Ca(OH)_2$ is added and the batch is further heated and maintained at 90–100° C. for 1 hour. Thereafter the mixture is heated to 120° C. under a flow of nitrogen at 28 L/Hr (1.0 std. $ft^3$/hr.). When 120° C. is reached, 252 g diluent oil is added. The mixture is stripped under a nitrogen flow at 150° C. and isolated by filtration. The resulting product contains 14 mole % aldehyde functionality.

Part B

Into a 12 L four-necked flask equipped with stirrer, thermowell, reflux condenser and subsurface tube is charged 5000 g of the product from Part A, 315 g of polyisobutene ($\overline{M}n$=1000) substituted succinic anhydride, 376 g $Ca(OH)_2$ and 863 grams of an alcohol mixture containing 88–96% by weight ethyl alcohol, 4–5% by weight isopropyl alcohol and 0–8% by weight water. The mixture is heated to 63° C. and 10 grams glacial acetic acid are added. The mixture is held at approximately 60° C. for one hour. Carbon dioxide is blown through the mixture for 3 hours at approximately 0.5 std. $ft^3$/hr. to a direct base number of 56.4. A second increment of 370 grams $Ca(OH)_2$ is added and carbon dioxide is similarly blown through the mixture over seven hours to a direct base number of 39.8. The mixture is stripped to 145° C. under a nitrogen flow of 1.5 std. $ft^3$/hr. and maintained at that temperature for 1 hour at 2.0 std. $ft^3$/hr. The product is diluted with toluene, centrifuged, decanted from the resulting solids and restripped to 130–140° C. and 60 mmHg vacuum. The product is filtered and exhibits a TBN of 205, containing 7.2% by weight Ca.

(F) Phosphorus-Containing Metal Salt

The phosphorus-containing metal salt, which typically functions as an extreme pressure (EP) additive, may be added to the inventive lubricating oil composition, provided that the amount of phosphorus contributed to the lubricating oil composition by this additive does not exceed about 0.08% by weight of the lubricating oil composition, and the amount of sulfur does not exceed about 0.25% by weight. The phosphorus-containing acids useful in making these EP additives may be represented by the formula:

(F-I)

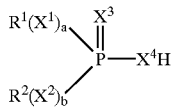

wherein in Formula (F-I): $X^1$, $X^2$, $X^3$ and $X^4$ are independently oxygen or sulfur, a and b are independently zero or one, and $R^1$ and $R^2$ are independently hydrocarbyl groups. Illustrative examples include: dihydrocarbyl phosphinodithioic acids, S-hydrocarbyl hydrocarbyl phosphonotrithioic acids, O-hydrocarbyl hydrocarbyl phosphinodithioic acids, S,S-dihydrocarbyl phosphorotetrathioic acids, O,S-dihydrocarbyl phosphorotrithioic acids, O,O-dihydrocarbyl phosphorodithioic acids, and the like.

Useful phosphorus-containing acids are phosphorus- and sulfur-containing acids. These include those acids wherein in Formula (F-I) at least one $X^3$ or $X^4$ is sulfur, and in one embodiment both $X^3$ and $X^4$ are sulfur, at least one $X^1$ or $X^2$ is oxygen or sulfur, and in one embodiment both $X^1$ and $X^2$ are oxygen, and a and b are each 1. Mixtures of these acids may be employed in accordance with this invention.

$R^1$ and $R^2$ in Formula (F-I) are independently hydrocarbyl groups that are preferably free from acetylenic unsaturation and usually also from ethylenic unsaturation and in one embodiment have from about 1 to about 50 carbon atoms, and in one embodiment from about 1 to about 30 carbon atoms, and in one embodiment from about 3 to about 18 carbon atoms, and in one embodiment from about 3 to about 8 carbon atoms. Each $R^1$ and $R^2$ can be the same as the other, although they may be different and either or both may be mixtures. Examples of $R^1$ and $R^2$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof. Particular examples of useful mixtures include, for example, isopropyl/n-butyl; isopropyl/secondary butyl; isopropyl/4-methyl-2-pentyl; isopropyl/2-ethyl-1-hexyl; iso-propyl/isooctyl; isopropyl/decyl; isopropyl/dodecyl; and isopropylitridecyl.

In one embodiment, the phosphorus-containing compound represented by formula (F-1) is a compound where a and b are each 1, $X^1$ and $x^2$ are each O, and $R^1$ and $R^2$ are derived from one or more primary alcohols, one or more secondary alcohols, or a mixture of at least one primary alcohol and at least one secondary alcohol. Examples of useful alcohol mixtures include: isopropyl alcohol and isoamyl alcohol; isopropyl alcohol and isooctyl alcohol; secondary butyl alcohol and isooctyl alcohol; n-butyl alcohol and n-octyl alcohol; n-pentyl alcohol and 2-ethyl-1-hexyl alcohol; isobutyl alcohol and n-hexyl alcohol; isobutyl alcohol and isoamyl alcohol; isopropyl alcohol and 2-methyl-4-pentyl alcohol; isopropyl alcohol and sec-butyl alcohol; isopropyl alcohol and isooctyl alcohol; isopropyl alcohol, n-hexyl alcohol and isooctyl alcohol, etc. These include a mixture of about 40 to about 60 mole % 4-methyl-2-pentyl alcohol and about 60 to about 40 mole % isopropyl alcohol; a mixture of about 40 mole % isooctyl alcohol and about 60 mole % isopropyl alcohol; a mixture of about 40 mole % 2-ethylhexyl alcohol and about 60 mole % isopropyl alcohol; and a mixture of about 35 mole % primary amyl alcohol and about 65 mole % isobutyl alcohol.

The preparation of the metal salts of the phosphorus-containing acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water or diluent oil. Neutral salts are prepared by reacting one equivalent of metal oxide or hydroxide with one equivalent of the acid. Basic metal salts are prepared by adding an excess of (more than one equivalent) the metal oxide or hydroxide to one equivalent of the phosphorus-containing acid.

The metal salts of the phosphorus-containing acids represented by Formula (F-I) which are useful include those salts containing Group IA, IIA or IIB metals, aluminum, lead, tin, iron, molybdenum, manganese, cobalt, nickel or bismuth. Zinc is a useful metal. These salts can be neutral salts or overbased salts. Examples of useful metal salts of phosphorus-containing acids, and methods for preparing such salts are found in the prior art such as U.S. Pat. Nos. 4,263,150,4,289,635; 4,308,154; 4,322,479; 4,417,990; and 4,466,895, and the disclosures of these patents are hereby incorporated by reference. These salts include the Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The phosphorus-containing metal salt (F) may be employed in the inventive lubricating oil composition at a concentration in the range of up to about 2.5% by weight, and in one embodiment about 0.1 to about 2.5% percent by weight, and in one embodiment about 0.2% to about 2% by weight, and in one embodiment about 0.2 to about 1.5% by weight. These compounds can be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., $C_{10}$–$C_{13}$ alkyl) benzene, toluene or xylene to form an additive concentrate. These concentrates usually contain from about 1% to about 99% by weight, and in one embodiment about 10% to about 90% by weight of the diluent.

(G) Dispersant Viscosity Index Modifier

The dispersant viscosity index modifier (G) is a multifunctional additive that provides both viscosity improving properties and dispersant properties. These additives are known in the art and are commercially available. These additives are described in numerous publications including Dieter Klamann, "Lubricants and Related Products", Verlag Chemie Gmbh (1984), pp 185–193; C. V. Smalheer and R. K. Smith "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp (1978), pp 139–164; M. W. Ranney, "Synthetic Oils and Additives for Lubricants", Noyes Data Corp. (1980), pp 96–166; and U.S. Pat. No. 5,719,107. These publications are incorporated herein by reference.

Dispersant viscosity index modifiers are generally one or a mixture of polymers which perform several functions. They serve first as a viscosity index ("VI") modifier, sometimes referred to as a viscosity index improver. This is the well-known function of controlling the rate or amount of viscosity change of a lubricant as a function of temperature. These materials impart comparatively little thickening effect at low temperatures and significant thickening at high temperatures. This behavior extends the temperature range over which a lubricant can be used.

The dispersant viscosity index modifiers contain functional groups which provide dispersant functionality (and sometimes other functionality, such as antioxidation properties) to the lubricant composition. Dispersant functionality serves to prevent particulate contamination in an oil or other lubricant from agglomerating into larger particles which can settle out as sludge or varnish.

The dispersant viscosity index modifiers typically comprise an oil soluble polymeric hydrocarbon backbone having a weight average molecular weight greater than about 20,000, and in one embodiment from about 20,000 to about 500,000 or greater. In general, these dispersant viscosity index modifiers are functionalized polymers. For example the dispersant viscosity index modifier may be an olefin copolymer (e.g., an inter-polymer of ethylene-propylene) or an acrylate or methacrylate copolymer that is grafted with an active monomer such as maleic anhydride and then derivatized with, for example, an alcohol or amine.

Representative examples of suitable viscosity index modifiers include polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/soprene, styrene/butadiene, and isoprene/butadiene, as well as the partially hydrogenated homopolymers of butadiene and isoprene and isoprene/divinylbenzene.

Typically, dispersancy functionally is introduced by post reacting a viscosity index modifier to introduce polar groups. See, for example, U.S. Pat. Nos. 4,517,104, 4,780, 228, 4,699,723, and 4,948,524. Free radical functionalization of star and block copolymers of hydrogenated diene styrene is described in U.S. Pat. No. 5,049,294. If the viscosity modifier is a polymethacrylate, dispersancy may be introduced when the polymer is made by incorporating a small amount of nitrogen-containing monomer such as vinylpyridine as described in U.S. Pat. No. 4,618,439. The foregoing patents are incorporated herein by reference.

Derivatives of polyacrylate esters are well-known as dispersant viscosity index modifiers. Dispersant acrylate or polymethacrylate viscosity modifiers such as Acryloid™ 985,Viscoplex™ 6-054, or Viscoplex™ 2-500 from RohMax, or LZ® 7720C from The Lubrizol Corporation, are useful.

The dispersant viscosity index modifier (G) may be employed in the inventive lubricating oil composition at a concentration in the range of up to about 10% by weight, and in one embodiment up to about 4% by weight, and in one embodiment about 0.5 to about 4% percent by weight, and in one embodiment about 0.5% to about 3% by weight. These materials can be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., $C_{10}$–$C_{13}$ alkyl) benzene, toluene or xylene to form an additive concentrate. These concentrates usually contain from about 1% to about 99% by weight, and in one embodiment about 10% to about 90% by weight of the diluent.

(H) Other Optional Additives

The inventive lubricating oil composition may contain, in addition to the acylated nitrogen-containing compounds (C) and the dispersant viscosity index modifiers (G) referred to above, one or more detergents or dispersants of the ashless type. These ashless detergents and dispersants are so called despite the fact that, depending on their constitution, they may upon combustion yield a non-volatile material such as boric oxide or phosphorus pentoxide; however, they do not ordinarily contain metal and therefore do not yield a metal-containing ash on combustion. Many types are known in the art, and are suitable for use in the these lubricating oil compositions. These include the following:

(1) Reaction products of carboxylic acids (or derivatives thereof) containing at least about 34, and in one embodiment at least about 54 carbon atoms, with nitrogen containing compounds such as amines, organic hydroxy compounds such as phenols and alcohols, and/or basic inorganic materials. Examples of these "carboxylic dispersants" are described in many U.S. Patents including U.S. Pat. Nos. 3,219,666; 4,234,435; 4,904,401; and 6,165,235.

(2) Reaction products of relatively high molecular weight aliphatic or alicyclic halides with amines, preferably oxyalkylene polyamines. These may be characterized as "amine dispersants" and examples thereof are described for example, in the following U.S. Pat. Nos. 3,275,554; 3,438, 757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Patents are illustrative: U.S. Pat. Nos. 3,649, 229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos. 3,329,658; 3,449, 250; 3,519,565; 3,666,730; 3,687,849; and 3,702,300.

The above-noted patents are incorporated by reference herein for their disclosures of ashless dispersants.

The inventive lubricating oil composition may also contain other lubricant additives known in the art. These include, for example, corrosion-inhibiting agents, antioxidants, viscosity modifiers, pour point depressants, friction modifiers, fluidity modifiers, copper passivators, anti-foam agents, etc.

Pour point depressants are used to improve the low temperature properties of oil-based compositions. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional antifoam compositions are described in "Foam Control Agents," by Henry T. Kerner (Noyes Data Corporation, 1976), pages 125–162. This reference is incorporated herein by reference.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges from about 0.001% to about 20% by weight, and in one embodiment about 0.01% to about 10% by weight based on the total weight of the lubricating oil composition. These additives can be added directly to the lubricating oil composition. In one embodiment, however, they are diluted with a substantially inert, normally liquid organic diluent such as mineral oil, synthetic oil, naphtha, alkylated (e.g., $C_{10}$–$C_{13}$ alkyl) benzene, toluene or xylene to form an additive concentrate. These concentrates usually contain from about 1% to about 99% by weight, and in one embodiment about 10% to about 90% by weight of such diluent.

EXAMPLES

The following Examples 1 and 2 are provided to further disclose the invention. Example C-1 is not within the scope of the invention, but is provided for purposes of comparison. Each example consists of a lubricating oil composition which is disclosed in the table below. In the table below, all numerical values relating to the ingredients (except of the antifoam agent) of each exemplified lubricating oil composition are in percent by weight of the composition. The antifoam agent concentration is expressed in parts per million weight. The exemplified lubricating oil compositions are tested using one or more of the following tests and the results of such tests are also reported in the table below.

Motorized Valve Train Wear Test

The motorized valve train wear test uses a full-scale cylinder head driven by an electric AC motor and operated by a Camille data acquisition and control computer system. The test sequence consists of 100, one hour cycles with two stages in each cycle. Stage one is run for fifty minutes at 800 rpm. Stage two is run for ten minutes at 1500. The oil sample is contaminated by an oxidizing agent, water, and fuel. Wear measurements are conducted by measuring all 12 cam lobes. Wear is expressed in microns of lost material.

Screen Valve Train Wear Test

This test uses a CH-4 Cummins M-11 diesel engine to determine heavy duty diesel valve train wear performance. The CH-4 Cummins M-11 is a turbocharged in-line 6 cylinder, 11 liter engine. The engine test is broken into four stages. During the first and third stage, the engine is overfueled and is operated with retarded timing to generate soot at an accelerated state. The second and fourth stages are run at a lower speed and higher torque to induce wear.

| | C-1 | 1 | 2 |
|---|---|---|---|
| Base Oil: 90% 200N mineral oil + 10% 100N mineral oil | 79.14 | 78.25 | 78.47 |
| Viscosity modifier: LZ 7095D available from Lubrizol identified as olefin polymer dispersed in oil (89% diluent oil) | 8.2 | 8.2 | 8.2 |
| Pour point depressant: Styrene-maleic anhydride copolymer dispersed in oil (53.6% diluent oil) | 0.20 | 0.20 | 0.20 |
| Dispersant: succinimide dispersant derived from polyisobutene ($\overline{Mn}$ = 2000) substituted succinic anhydride and polyethylene amines dispersed in oil TBN = 27, nitrogen content = 1.16% (50% diluent oil) | 7.2 | 7.2 | 7.2 |
| Detergent: calcium sulfonate dispersed in oil, TBN = 85 (47% diluent oil) | 0.38 | 0.38 | 0.38 |
| Detergent: calcium sulfonate dispersed in oil, TBN = 300 (42% diluent oil) | 2.05 | 2.05 | 2.05 |
| Detergent: Product of Example E-1 | 1.31 | 1.31 | 1.31 |
| Antioxident: hindered phenolic $C_4$ ester | 0.4 | 0.4 | 0.4 |
| Antioxident: Nonylated diphenyl amine | 0.2 | 0.2 | 0.2 |
| Antiwear: Durad 310M (product of FMC identified as tri (alkyl phenol) phosphate) | — | 0.89 | — |
| Antiwear: triphenyl phosphite | — | — | 0.67 |
| EP Additive: zinc dialkyl dithiophosphate dispersed in oil, TBN = 5 (9% diluent oil) | 0.5 | 0.5 | 0.5 |
| Copper passivator: 1,3,4-thiadiazole-2,5-bis (tert-nonyl dithio) having a nitrogen content of 6.4% | 0.03 | 0.03 | 0.03 |
| Diluent oil | 0.39 | 0.39 | 0.39 |
| Antifoam: polydimethylsiloxane dispersed in oil (90% diluent oil) | 100 ppm | 100 ppm | 100 ppm |

-continued

| | C-1 | 1 | 2 |
|---|---|---|---|
| Chemical analysis: | | | |
| Phosphorous, % | 0.05 | 0.115 | 0.115 |
| Sulfur, % | 0.17 | 0.17 | 0.17 |
| Magnesium, ppm | 200 | 200 | 200 |
| Ash content, % | 1.08 | 1.05 | 1.05 |
| Motorized Valve Train Wear Test, microns | 161 | 39 | 29 |
| Screen Valve Train Wear Test, mg. | 8.57 | 4.1 | — |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating oil composition, comprising:

(A) a base oil; and (B) a phosphorus-containing compound represented by the formulae:

(B-I)

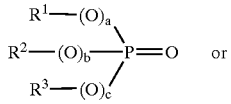

or (B-II)

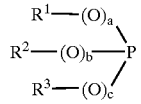

wherein in Formulae (B-I) and (B-II), $R^1$, $R^2$ and $R^3$ are independently hydrogen or hydrocarbyl groups, and a, b and c are independently zero or 1;

(E) an alkali or alkaline earth metal salt of a hydrocarbon-substituted saligenin;

the lubricating oil composition being characterized by a sulfur content of about 0.01 to about 0.25% by weight.

2. The composition of claim 1 wherein the composition further comprises (C) an acylated nitrogen-containing compound having a substituent of at least about 10 aliphatic carbon atoms.

3. The composition of claim 1 wherein the composition further comprises (D) an alkali or alkaline earth metal salt of an organic sulfur acid, a carboxylic acid or a phenol.

4. The composition of claim 1 wherein the lubricating composition further comprises (F) a metal salt of a phosphorus-containing compound represented by the formula:

(F-I)

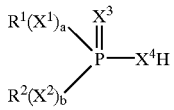

wherein in Formula (F-I), $X^1$, $X^2$, $X^3$ and $X^4$ are independently O or S; a and bare independently zero or 1; and $R^1$ and $R^2$ are independently hydrocarbyl groups.

5. The composition of claim 1 wherein the lubricating oil composition further comprises (G) a dispersant viscosity index modifier.

6. The composition of claim 1 wherein in Formula (B-I), $R^1$, $R^2$ and $R^3$ are independently aromatic or alkyl aromatic groups, and a, b and c are each 1.

7. The composition of claim 1 wherein (B) is a tri (alkylphenol) phosphate or a triphenyl phosphite.

8. The composition of claim 2 wherein the acylated nitrogen-containing compound (C) is derived from a carboxylic acylating agent and at least one amino compound containing at least one —NH— group, the acylating agent being linked to the amino compound through an imido, amido, amidine or salt linkage.

9. The composition of claim 8 wherein the amino compound is an alkylenepolyamine represented by the formula:

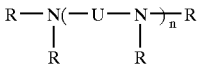

wherein U is an alkylene group of from about 2 to about 10 carbon atoms; each R is independently a hydrogen atom, a hydrocarbyl group, a hydroxy-substituted hydrocarbyl group, or an amine-substituted hydrocarbyl group containing up to about 30 carbon atoms, with the proviso that at least one R is a hydrogen atom; and n is 1 to about 10.

10. The composition of claim 2 wherein the acylated nitrogen-containing compound (C) is a polyisobutene substituted succinimide containing at least about 50 aliphatic carbon atoms in the polyisobutene group.

11. The composition of claim 3 wherein (D) is a neutral or basic alkali or alkaline earth metal sulfonate, carboxylate or phenate.

12. The composition of claim 3 wherein (D) is a neutral or basic alkali or alkaline earth metal salt of an aliphatic-hydrocarbon substituted salicylic acid or a lactone.

13. The composition of claim 3 wherein the alkali or alkaline earth metal in (D) is calcium or magnesium.

14. The composition of claim 1 wherein (E) is a compound represented by the formula:

(E-I)

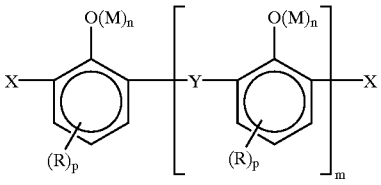

wherein in Formula (E-I): each X independently is —CHO or —$CH_2OH$; each Y independently is —$OH_2$— or —$CH_2OCH_2$—; wherein the —CHO groups comprise at least about 10 mole percent of the X and Y groups; each M is independently the valance of an alkali or alkaline earth metal ion; each R is independently a hydrocarbyl group containing 1 to about 60 carbon atoms; m is 0 to about 10; n is 0 or 1 provided that when n is 0 the M is replaced with H; and each p is independently 0, 1, 2, or 3; provided that at least one aromatic ring contains an R substituent and that the total number of carbon atoms in all R groups is at least 7; and further provided that if m is 1 or greater, then one of the X groups can be —H.

15. The composition of claim 4 wherein (F) is a zinc dialkyl dithiophosphate.

16. The composition of claim 5 wherein (G) is an olefin copolymer or an acrylate or methacrylate copolymer which is grafted with maleic anhydride and then derivatized with an alcohol or an amine.

17. The composition of claim 1 wherein the lubricating oil composition further comprises at least one ashless detergent or dispersant, corrosion-inhibiting agent, antioxidant, viscosity modifier, pour point depressant, friction modifier, fluidity modifier, copper passivator or anti-foam agent.

18. A lubricating oil composition made by combining:

(A) a base oil;

(B) a phosphorus-containing compound represented by the formulae:

(B-I)

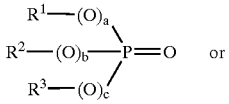

or (B-II)

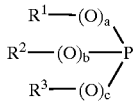

wherein in Formulae (B-I) and (B-II), $R^1$, $R^2$ and $R^3$ are independently hydrogen or hydrocarbyl groups, and a, b and c are independently zero or 1; and (E) a compound represented by the formula:

(E-I)

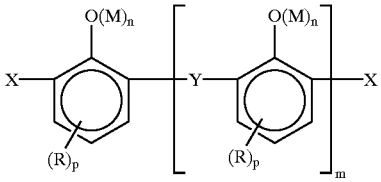

wherein in Formula (E-I): each X independently is —CHO or —$CH_2OH$; each Y independently is —$CH_2$— or —$CH_2OCH_2$—; wherein the —CHO groups comprise at least about 10 mole percent of the X and Y groups; each M is independently a calcium or magnesium ion; each R is independently a hydrocarbyl group containing 1 to about 60 carbon atoms; m is 0 to about 10; n is 0 or 1 provided that when n is 0 the M is replaced with H; and each p is independently 0, 1, 2, or 3; provided that at least one aromatic ring contains an R substituent and that the total number of carbon atoms in all R groups is at least 7; and further provided that if m is 1 or greater, then one of the X groups can be —H;

the lubricating oil composition being characterized by a sulfur content of about 0.01 to about 0.25% by weight.

19. A lubricating oil composition made by combining:

(A) a base oil;

(B) a phosphorus-containing compound represented by the formulae:

(B-I)

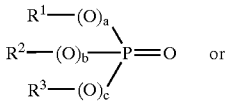

or

-continued (B-II)

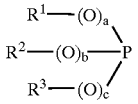

wherein Formulae (B-I) and (B-II), $R^1$, $R^2$ and $R^3$ are independently hydrogen or hydrocarbyl groups, and a, b and c are independently zero or 1;

(C) a polyisobutene substituted succinimide containing at least about 50 aliphatic carbon atoms in the polyisobutene group;

(D) a calcium or magnesium salt of an organic sulfur acid, a carboxylic acid, a lactone or a phenol;

(E) a compound represented by the formula:

(E-I)

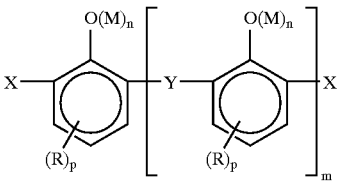

wherein in Formula (E-I): each X independently is —CHO or —$CH_2OH$; each Y independently is —$CH_2$— or —$CH_2OCH_2$—; wherein the —CHO groups comprise at least about 10 mole percent of the X and Y groups; each M is a calcium or magnesium ion; each R is independently a hydrocarbyl group containing 1 to about 60 carbon atoms; m is 0 to about 10; n is 0 or 1 provided that when n is 0 the M is replaced with H; and each p is independently 0, 1, 2, or 3; provided that at least one aromatic ring contains an R substituent and that the total number of carbon atoms in all R groups is at least 7; and further provided that if m is 1 or greater, then one of the X groups can be —H; and (F) a zinc dialkyl dilhiophosphate;

the lubricating oil composition being characterized by a sulfur content of about 0.01 to about 0.25% by weight and a phosphorus content of about 0.02 to about 0.14% by weight.

20. The composition of claim 18 wherein the composition further comprises (C) an acylated nitrogen-containing compound having a substituent of at least about 10 aliphatic carbon atoms.

21. The composition of claim 20 wherein the acylated nitrogen-containing compound (C) is derived from a carboxylic acylating agent and at least one amino compound containing at least one —NH— group, the acylating agent being linked to the amino compound through an imido, amido, amidine or salt linkage.

22. The composition of claim 20 wherein the acylated nitrogen-containing compound (C) is a polyisobutene substituted succinimide containing at least about 50 aliphatic carbon atoms in the polyisobutene group.

23. The composition of claim 18 wherein the composition further comprises (D) an alkali or alkaline earth metal salt of an organic sulfur acid, a carboxylic acid or a phenol.

24. The composition of claim 23 wherein (D) is a neutral or basic alkali or alkaline earth metal sulfonate, carboxylate or phenate.

25. The composition of claim 23 wherein (D) is a neutral or basic alkali or alkaline earth metal salt of an aliphatic-hydrocarbon substituted salicylic acid or a lactone.

26. The composition of claim 23 wherein the alkali or alkaline earth metal in (D) is calcium or magnesium.

27. The composition of claim 18 wherein the lubricating composition further comprises (F) a metal salt of a phosphorus-containing compound represented by the formula:

(F-I)

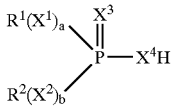

wherein in Formula (F-I), $X^1$, $X^2$, $X^3$ and $X^4$ are independently O or S; a and b are independently zero or 1; and $R^1$ and $R^2$ are independently hydrocarbyl groups.

28. The composition of claim 27 wherein (F) is a zinc dialkyl dithiophosphate.

29. The composition of claim 18 wherein the lubricating oil composition further comprises (G) a dispersant viscosity index modifier.

30. The composition of claim 29 wherein (G) is an olefin copolymer or an acrylate or methacrylate copolymer which is grafted with maleic anhydride and then derivatized with an alcohol or an amine.

31. The composition of claim 18 wherein in Formula (B-I), $R^1$, $R^2$ and $R^3$ are independently aromatic or alkyl aromatic groups, and a, b and c are each 1.

32. The composition of claim 18 wherein (B) is tri (alkylphenol) phosphate or a triphenyl phosphite.

33. The composition of claim 18 wherein the lubricating oil composition further comprises at least one ashless detergent or dispersant, corrosion-inhibiting agent, antioxidant, viscosity modifier, pour point depressant, friction modifier, fluidity modifier, copper passivator or anti-foam agent.

* * * * *